US006058870A

United States Patent [19]

Conley

[11] Patent Number: 6,058,870

[45] Date of Patent: May 9, 2000

[54] BREACH FILLING DEVICE

[76] Inventor: John Edgar Conley, 2038 Palm St. #508, Las Vegas, Nev. 89104

[21] Appl. No.: 09/105,436

[22] Filed: Jun. 26, 1998

[51] Int. Cl.[7] ..... B63B 43/16

[52] U.S. Cl. ..... 114/227

[58] Field of Search ..... 114/227–229

[56] References Cited

U.S. PATENT DOCUMENTS

| | | | |
|---|---|---|---|
| 3,866,560 | 2/1975 | Steward | 114/227 |
| 4,012,822 | 3/1977 | Vrolyk et al. | 29/700 |
| 4,329,132 | 5/1982 | Melvold et al. | 114/227 |
| 4,390,333 | 6/1983 | Dubois | 114/227 |

FOREIGN PATENT DOCUMENTS

| | | | |
|---|---|---|---|
| 572398 | 9/1977 | U.S.S.R. | 114/227 |
| 878648 | 11/1981 | U.S.S.R. | 114/227 |

*Primary Examiner*—Sherman Basinger

[57] ABSTRACT

A new breach filling device for plugging a hole in a structure, in particular, in a boat. The inventive device includes a container having a reservoir for holding a foaming material therein and a flexible inflatable bladder having an interior space. The interior space of the inflatable bladder is in fluid communication with the reservoir of the container to permit passage of foaming material from the reservoir of the container into interior space of the inflatable bladder. The foaming material forms a foamed material in the interior space of the inflatable bladder such that the foamed material inflates the inflatable bladder.

13 Claims, 4 Drawing Sheets

24
10
32
26
25
11
16
18
28
29
17
26
25
35
22
2
1
21
23
34
33

24

26
25
35
22
34
20
33
21
34
23

BREACH FILLING DEVICE

BACKGROUND OF THE INVENTION

1. Field of the Invention

The present invention relates to devices for plugging a hole in boats and more particularly pertains to a new breach filling device for plugging a hole in a structure, in particular, in a boat.

2. Description of the Prior Art

The use of devices for plugging a hole in boats is known in the prior art. More specifically, devices for plugging a hole in boats heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for plugging a hole in boats include U.S. Pat. No. 5,245,941; U.S. Pat. No. 5,253,602; U.S. Pat. No. 3,841,256; U.S. Pat. No. 5,143,012; U.S. Pat. No. 5,845; and U.S. Pat. No. 2,220,085.

While these devices fulfill their respective, particular objectives and requirements, the aforementioned patents do not disclose a new breach filling device. The inventive device includes a container having a reservoir for holding a foaming material therein and a flexible inflatable bladder having an interior space. The interior space of the inflatable bladder is in fluid communication with the reservoir of the container to permit passage of foaming material from the reservoir of the container into interior space of the inflatable bladder. The foaming material forms a foamed material in the interior space of the inflatable bladder such that the foamed material inflates the inflatable bladder.

In these respects, the breach filling device according to the present invention substantially departs from the conventional concepts and designs of the prior art, and in so doing provides an apparatus primarily developed for the purpose of plugging a hole in a structure, in particular, in a boat.

SUMMARY OF THE INVENTION

In view of the foregoing disadvantages inherent in the known types of devices for plugging a hole in boats now present in the prior art, the present invention provides a new breach filling device construction wherein the same can be utilized for plugging a hole in a structure, in particular, in a boat.

The general purpose of the present invention, which will be described subsequently in greater detail, is to provide a new breach filling device apparatus and method which has many of the advantages of the devices for plugging a hole in boats mentioned heretofore and many novel features that result in a new breach filling device which is not anticipated, rendered obvious, suggested, or even implied by any of the prior art devices for plugging a hole in boats, either alone or in any combination thereof.

To attain this, the present invention generally comprises a container having a reservoir for holding a foaming material therein and a flexible inflatable bladder having an interior space. The interior space of the inflatable bladder is in fluid communication with the reservoir of the container to permit passage of foaming material from the reservoir of the container into interior space of the inflatable bladder. The foaming material forms a foamed material in the interior space of the inflatable bladder such that the foamed material inflates the inflatable bladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new breach filling device apparatus and method which has many of the advantages of the devices for plugging a hole in boats mentioned heretofore and many novel features that result in a new breach filling device which is not anticipated, rendered obvious, suggested, or even implied by any of the prior art devices for plugging a hole in boats, either alone or in any combination thereof.

It is another object of the present invention to provide a new breach filling device which may be easily and efficiently manufactured and marketed.

It is a further object of the present invention to provide a new breach filling device which is of a durable and reliable construction.

An even further object of the present invention is to provide a new breach filling device which is susceptible of a low cost of manufacture with regard to both materials and labor, and which accordingly is then susceptible of low prices of sale to the consuming public, thereby making such breach filling device economically available to the buying public.

Still yet another object of the present invention is to provide a new breach filling device which provides in the apparatuses and methods of the prior art some of the advantages thereof, while simultaneously overcoming some of the disadvantages normally associated therewith.

Still another object of the present invention is to provide a new breach filling device for plugging a hole in a structure, in particular, in a boat.

Yet another object of the present invention is to provide a new breach filling device which includes a container having a reservoir for holding a foaming material therein and a flexible inflatable bladder having an interior space. The interior space of the inflatable bladder is in fluid communication with the reservoir of the container to permit passage of foaming material from the reservoir of the container into interior space of the inflatable bladder. The foaming material forms a foamed material in the interior space of the inflatable bladder such that the foamed material inflates the inflatable bladder.

Still yet another object of the present invention is to provide a new breach filling device that may be used to plug a breach in the hull of a boat from both inside and outside the boat.

Even still another object of the present invention is to provide a new breach filling device that is portable so that it may be quickly and easily transported to the breach location.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
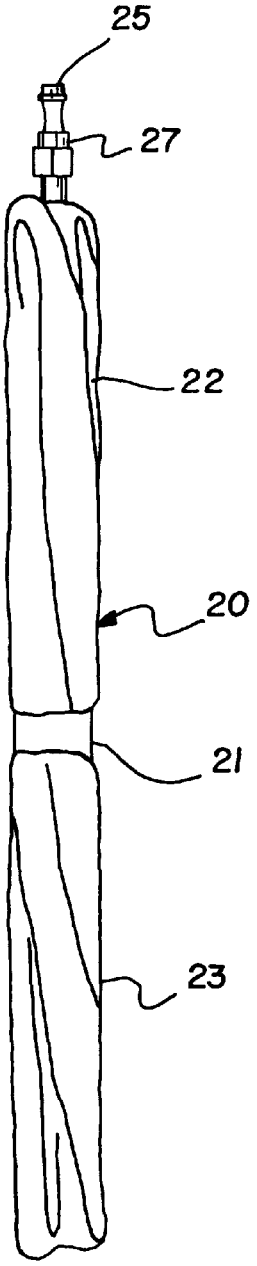
FIG. 1 is a schematic side view of a deflated bladder inflatable of a new breach filling device according to the present invention.

With reference now to the drawings, and in particular to FIGS. 1 through 8 thereof, a new breach filling device embodying the principles and concepts of the present invention and generally designated by the reference numeral 10 will be described.

In use, the breach filling device 10 is designed for providing a water-tight plug of a hole 2 in a structure I such as a breach in a hull or bulkhead of a boat. The breach filling device may be used from the interior side of the breach or from the water side of the breach to close the breach. As best illustrated in FIGS. 1 through 8, the breach filling device 10 generally comprises a container 11 having a reservoir for holding a foaming material therein and a flexible inflatable bladder 20 having an interior space. The interior space of the inflatable bladder 20 is in fluid communication with the reservoir of the container 11 to permit passage of foaming material from the reservoir of the container 11 into interior space of the inflatable bladder 20. The foaming material forms a foamed material in the interior space of the inflatable bladder 20 such that the foamed material inflates the inflatable bladder 20.

Figure 2:
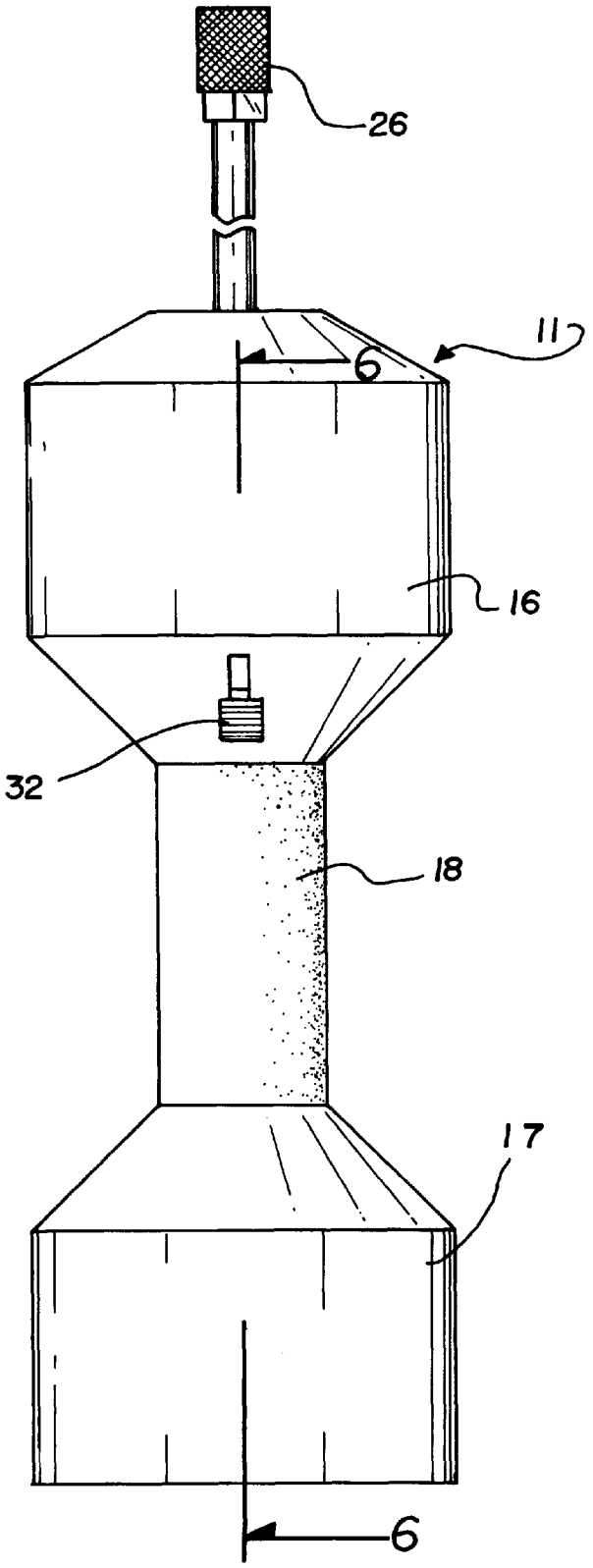
FIG. 2 is a schematic side view of the container of the present invention.

In closer detail, the portable container 11 has a reservoir therein for holding a foaming fluidic material therein. Ideally, the foaming material comprises a two component foaming polymer fluidic material 12, 13, such as a urethane and a reagent. Preferably, the reservoir of the container 11 comprises separate first and second component reservoirs 14, 15 for keeping the components 12, 13 of the foaming material separate in the container 11. In particular, the first component reservoir 14 is designed for holding one of the components 12 of the foaming material and the second component reservoir 15 is designed for holding the other component 13 of the foaming material. In the ideal embodiment, as illustrated in FIG. 2, the container 11 is generally dumbbell-shaped and has a pair of spaced apart lobes 16, 17 and a generally cylindrical handle 18 portion connecting the lobes 16, 17 of the container 11 together. The handle 18 is designed for permitting easy grasping of the container 11 by a user.

Figure 3:
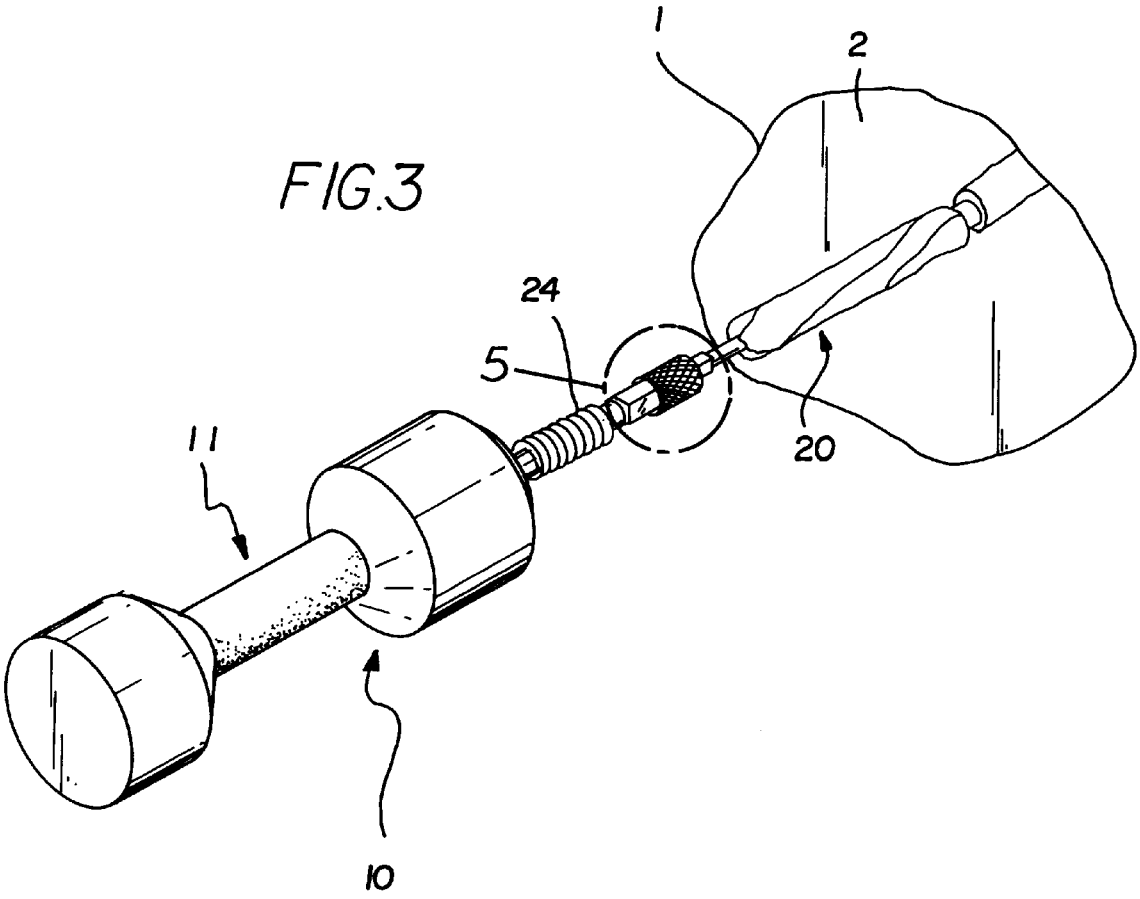
FIG. 3 is a schematic perspective view of the present invention with the deflated inflatable bladder in use being inserted into a hole in a structure.
Figure 4:
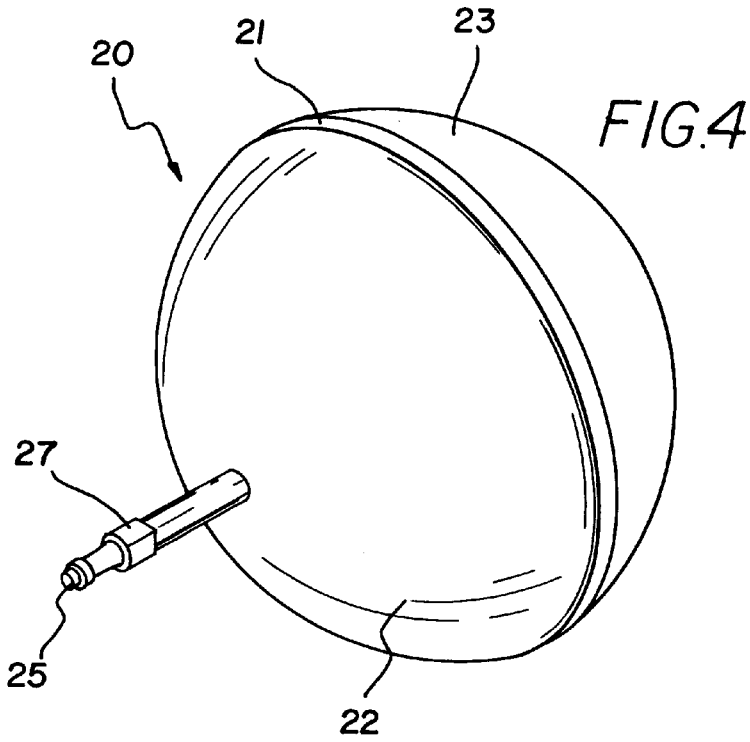
FIG. 4 is a schematic perspective view of an inflated inflatable bladder of the present invention.
Figure 6:
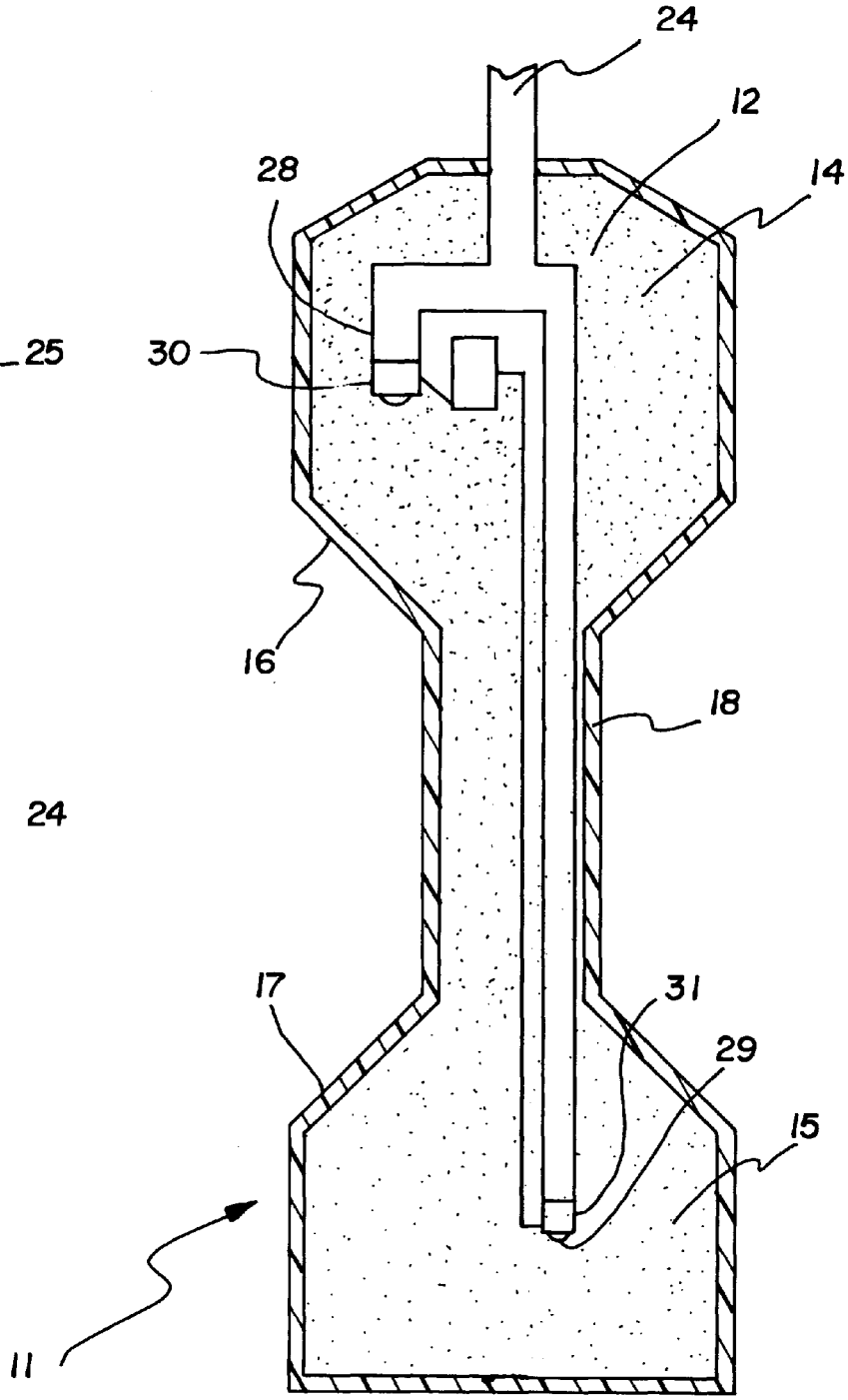
FIG. 6 is a schematic cross-sectional view of the container of the present invention taken from line 6—6 of FIG. 2.
Figure 8:
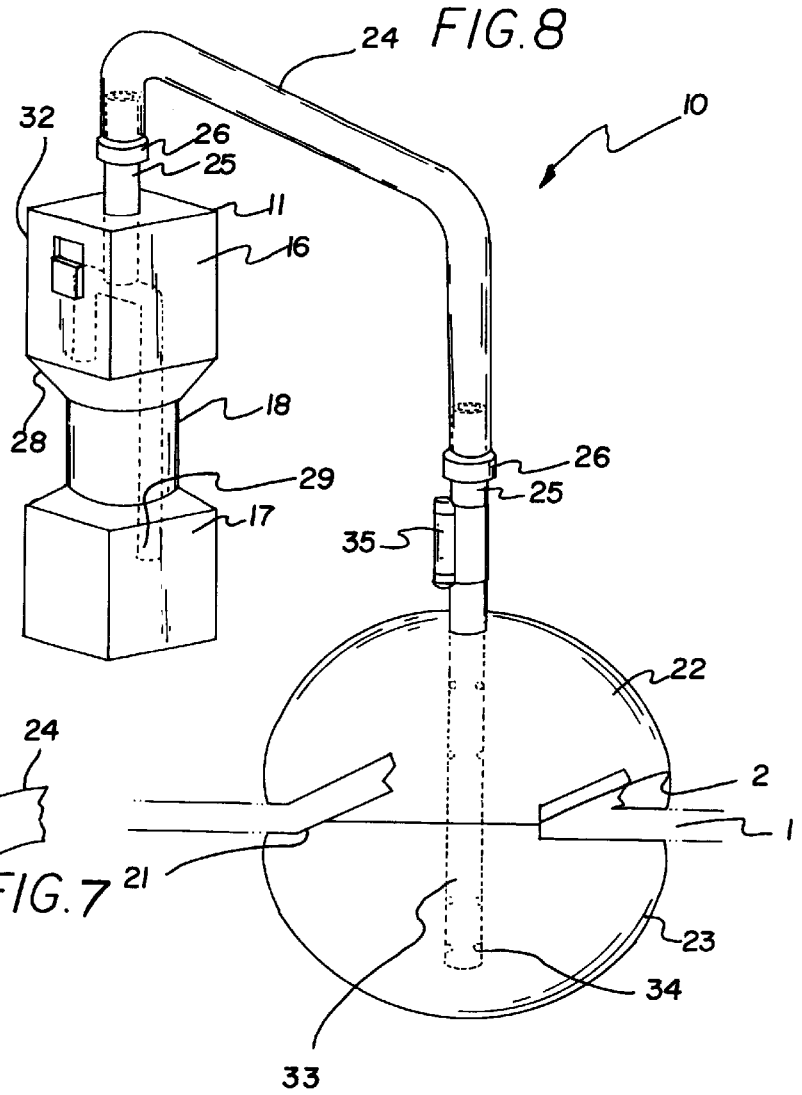
FIG. 8 is a schematic view of the present invention in use plugging a hole in a structure.

The breach filling device 10 also includes a flexible inflatable bladder 20 having an interior space. With reference to FIGS. 3 and 8, the inflatable bladder 20 is designed for inserting into a hole 2 in a structure 1 so that inflation of the inflatable bladder 20 closes the hole 2 in the structure 1. Preferably, inflation of the inflatable bladder 20 provides a substantially water tight closure of the hole 2 in the structure 1. As illustrated in FIG. 4, the inflatable bladder 20 is preferably generally spherical when inflated. Ideally, the inflatable bladder 20 comprises a rip resistant flexible material so that it can conform to unevenly shaped holes in a structure and will not be easily punctured by any sharp edges around the hole in the structure. The inflatable bladder 20 has an annular constriction 21, or seam, around the circumference of the inflatable bladder 20. The annular constriction 21 divides the inflatable bladder 20 into a pair of preferably generally hemispherical portions 22, 23. The annular constriction 21 defines an annular channel between the portions 22, 23 of the inflatable bladder 20. As illustrated in FIG. 6, the annular channel of the inflatable bladder 20 is designed for receiving the portion of the structure I around the periphery of the hole 2 in the structure 1 when the inflatable bladder 20 is inserted into the hole 2 in the structure 1 and inflated such that the structure 1 is sandwiched between the circumferences of the hemispherical portions 22, 23 of the inflatable bladder 20.

Figure 5:
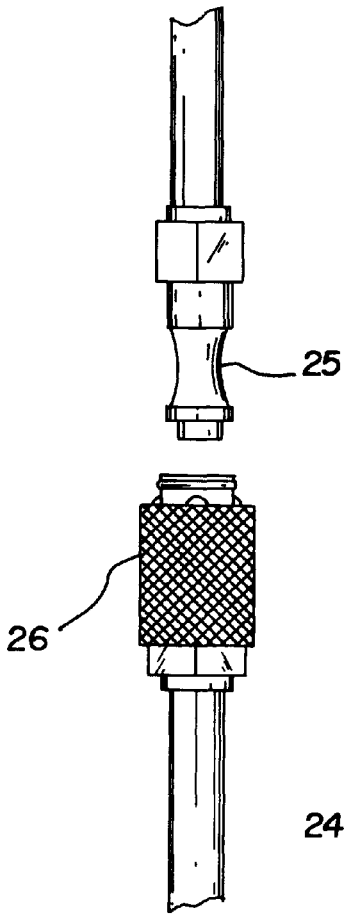
FIG. 5 is a schematic side view of a detachable coupling of the conduit of the present invention taken from the circle 5 on FIG. 3.

The interior space of the inflatable bladder 20 is in fluid communication with the reservoir of the container 11. Preferably, an elongate conduit 24 fluidly connects the interior space of the inflatable bladder 20 to the reservoir of the container 11 to permit passage of foaming material from the reservoir of the container 11 into interior space of the inflatable bladder 20. In use, the foaming material forms a foamed material (such as solidifying polyurethane of the type used for foamed insulation) in the interior space of the inflatable bladder 20 such that the foamed material inflates the inflatable bladder 20 to closed the hole 2 in the structure 1. Ideally, the conduit 24 comprises a flexible tube or hose and has a pair of opposite ends. One end of the conduit 24 is fluidly connected to the reservoir of the container 11 and the other end of the conduit 24 is fluidly connected to the interior space of the inflatable space. The one end of the conduit 24 is preferably detachably attached to the container 11 while the other end of the conduit 24 is also preferably detachably attached to the inflatable bladder 20. With reference to FIG. 5, ideally, the detachable attachments of the ends of the conduit 24 comprise a quick release plug 25 and socket 26 fluid connector. In the ideal embodiment, the inflatable bladder 20 also has a valve 27 for closing the opening into the inflatable bladder 20 when the other end of the conduit 24 is detached from the inflatable bladder 20.

In the preferred embodiment, the conduit 24 has a first intake 28 opening into the first component reservoir 14 of the container 11 and a second intake 29 opening into the second component reservoir 15 of the container 11. The conduit 24 also preferably has first and second valves 30, 31. The first valve 30 selectively closes the first intake 28 of the conduit 24 while the second valve 31 selectively closes the second intake 29 of the conduit 24. A release switch 32 is operationally connected to the first and second valves 30, 31. The release switch 32 permits opening of the first and second valves 30, 31 to permit the components of foaming material into the first and second intakes 28, 29 of the conduit 24. Preferably, the switch 32 is mounted to the exterior of the container 11 so that a user grasping the container can easily open valves.

Figure 7:
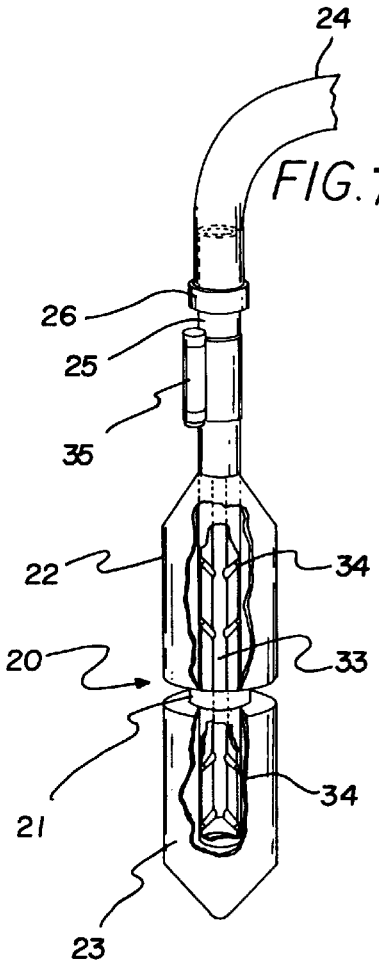
FIG. 7 is a schematic sectional view of the inflatable bladder of the present invention.

With reference to FIG. 7, the conduit 24 has an elongate nozzle 33 in the interior space of the inflatable bladder 20. The nozzle 33 has a plurality of apertures 34 providing openings into the conduit 24. The apertures 34 of the nozzle 33 permit passage of foaming material from the conduit 24 into the interior space of the inflatable bladder 20. As illustrate in FIG. 1, the inflatable bladder 20 is ideally folded around the nozzle 33 when the inflatable bladder 20 is deflated to help make it easier to insert the deflated inflatable bladder 20 in a hole 2 in a structure 1 as illustrated in FIG. 3. Optionally, a flashlight light source 35 may be coupled to the conduit 24 and positioned adjacent the second end of the conduit 24 adjacent the inflatable bladder 20. The flashlight 35 is designed for aiding the visibility of a user while inserting the inflatable bladder 20 into a hole 2 in a structure 1. This is especially helpful when water is gushing through the hole 2.

In use, the foaming material passes into the conduit 24 through the intakes 28, 29 and exits the conduit 24 from the apertures 34 of the nozzle 33 into the interior space of the inflatable bladder 20 to form a foam material which inflates the inflatable bladder 20. As illustrated in FIG. 8, the inflatable bladder 20 closes the hole 2 in the structure I from the both sides of the structure 1. Once the inflatable bladder 20 is inflated, water pressure on the portion 23 of the inflatable bladder 20 on the side of the structure 1 exposed to the water (such as the exterior side of a hull of a boat) presses the portion 23 of the inflatable bladder 20 against the structure 1 to help further keep the closure of the hole 2 in the structure 1 water tight.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A breach filling device for plugging a hole in a structure, said breach filling device comprising:

a container having a reservoir therein for holding a foaming material therein;

a flexible inflatable bladder having an interior space;

said interior space of said inflatable bladder being in fluid communication with said reservoir of said container to permit passage of foaming material from said reservoir of said container into interior space of said inflatable bladder;

said foaming material forming a foamed material in said interior space of said inflatable bladder such that said foamed material inflates said inflatable bladder; and said container having a pair of spaced apart lobes and a generally cylindrical handle portion connecting said lobes of said container together.

2. The breach filling device of claim 1, wherein said inflatable bladder has an annular constriction around the circumference of said inflatable bladder, said annular constriction dividing said inflatable bladder into a pair of portions, and said annular constriction defining an annular channel between said portions of said inflatable bladder.

3. The breach filling device of claim 2, wherein said inflatable bladder is generally spherical, and wherein said portions of said inflatable bladder are generally hemispherical.

4. The breach filling device of claim 1, wherein an elongate conduit fluidly connects said interior space of said inflatable bladder to said reservoir of said container.

5. The breach filling device of claim 4, wherein said conduit comprises a flexible tube and has a pair of opposite ends, a first end of said pair of ends of said conduit being fluidly connected to said reservoir of said container, and a second end of said pair of ends of said conduit being fluidly connected to said interior space of said inflatable bladder.

6. The breach filling device of claim 5, wherein said first end of said conduit is detachably attached to said container, and said second end of said conduit is detachably attached to said inflatable bladder.

7. The breach filling device of claim 4, wherein said conduit has an elongate nozzle in said interior space of said inflatable bladder, said nozzle having a plurality of apertures providing openings into said conduit, said apertures of said nozzle permitting passage of foaming material from said conduit into said interior space of said inflatable bladder.

8. The breach filling device of claim 1, wherein said foaming material comprises a two component foaming material, wherein said reservoir of said container comprises separate first and second component reservoirs, said first component reservoir for holding one of said components of said foaming material, said container having a second reservoir for holding another component of said foaming material.

9. The breach filling device of claim 8, said conduit has a first intake into said first component reservoir of said container, and wherein said conduit has a second intake into said second component reservoir of said container.

10. The breach filling device of claim 9, wherein said conduit has first and second valves, said first valve selectively closing said first intake of said conduit, said second valve selectively closing said second intake of said conduit.

11. The breach filling device of claim 10, further comprising a switch being connected to said first and second valves, said switch permitting opening of said first and second valves to permit said components of foaming material into said first and second intakes of said conduit.

12. The breach filling device of claim 11, wherein said switch is mounted to said container.

13. A breach filling device for plugging a hole in a structure, said breach filling device comprising:

a container having a reservoir therein for holding a foaming material therein, wherein said foaming material comprising a two component foaming material, wherein said reservoir of said container comprises separate first and second component reservoirs, said first component reservoir for holding one of said components of said foaming material, said container having a second reservoir for holding another component of said foaming material;

wherein said container has a pair of spaced apart lobes and a generally cylindrical handle portion connecting said lobes of said container together;

a flexible inflatable bladder being generally spherical and having an interior space;

said inflatable bladder having an annular constriction around the circumference of said inflatable bladder, said annular constriction dividing said inflatable bladder into a pair of portions, said portions of said inflatable bladder being generally hemispherical, said annular constriction defining an annular channel between said portions of said inflatable bladder;

an elongate conduit fluidly connecting said interior space of said inflatable bladder to said reservoir of said container to permit passage of foaming material from said reservoir of said container into interior space of said inflatable bladder, said foaming material forming a foamed material, in said interior space of said inflatable bladder such that said foamed material inflates said inflatable bladder;

wherein said conduit comprises a flexible tube and has a pair of opposite ends, a first end of said pair of ends of said conduit being fluidly connected to said reservoir of said container, a second end of said pair of ends of said conduit being fluidly connected to said interior space of said inflatable space;

said first end of said conduit being detachably attached to said container, said second end of said conduit being detachably attached to said inflatable bladder;

said conduit having a first intake into said first component reservoir of said container, said conduit having a second intake into said second component reservoir of said container;

said conduit having first and second valves, said first valve selectively closing said first intake of said conduit, said second valve selectively closing said second intake of said conduit;

a switch being connected to said first and second valves, said switch permitting opening of said first and second valves to permit said components of foaming material into said first and second intakes of said conduit, said switch being mounted to said container; and said conduit having an elongate nozzle in said interior space of said inflatable bladder, said nozzle having a plurality of apertures providing openings into said conduit, said apertures of said nozzle permitting passage of foaming material from said conduit into said interior space of said inflatable bladder.

* * * * *